United States Patent [19]

Scaglia

[11] Patent Number: 5,003,762

[45] Date of Patent: Apr. 2, 1991

[54] AUTOMATIC FEEDER AND FEEDING METHOD FOR TEXTILE MACHINES

[76] Inventor: Enzo Scaglia, 21, Via Monte Rosa, Milan, Italy, 20149

[21] Appl. No.: 297,617

[22] Filed: Jan. 17, 1989

[51] Int. Cl.[5] ..... D01H 9/18; B65H 67/06

[52] U.S. Cl. ..... 57/281; 242/35.5 A

[58] Field of Search ..... 57/90, 264, 265, 281, 57/276; 242/35.5 A, 35.5 R

[56] References Cited

U.S. PATENT DOCUMENTS

| | | | |
|---|---|---|---|
| 4,660,370 | 4/1987 | Matsui et al. | 57/264 X |
| 4,720,967 | 1/1988 | Guttler | 56/281 |
| 4,838,019 | 6/1989 | Ueda | 57/264 |
| 4,843,808 | 7/1989 | Ruge et al. | 57/281 X |

*Primary Examiner*—Stanley N. Gilreath

*Attorney, Agent, or Firm*—Lerner, David, Littenberg, Krumholz & Mentlik

[57] ABSTRACT

An endless structure for the continuous transport of a plurality of bobbins is disposed for operative association with one or more textile machines such as, for instance, spinning machines. Each bobbin is marked with a code according to whether the bobbin is empty or wound with sliver, as well as the type and count of the sliver wound thereabout. As the bobbin travels on the endless transport structure the code is read and the wound bobbins are directed to an appropriate textile machine for unwinding. Empty bobbins are removed from the textile machine and carried by the endless transport structure to an exit station. At the exit station, empty bobbins are loaded into a sliver winder for rewinding with sliver. Once wound, the bobbins are marked with a new code and inserted back onto the endless transport structure.

16 Claims, 3 Drawing Sheets

AUTOMATIC FEEDER AND FEEDING METHOD FOR TEXTILE MACHINES

BACKGROUND OF THE INVENTION

The present invention concerns an automatic feeder for textile machines and a related feeding method. More particularly, the present invention concerns an automatic continuous feeder of bobbins or reels of sliver to a series of spinning machines, together with the related feeding method.

In present methods for feeding spinning machines or other textile machines,, a storage area is provided for the bobbins or reels of sliver. From the storage area the bobbins or reels are taken to the spinning machine, where the sliver undergoes known processes of stretching and twisting. The principal disadvantage of this method is that, besides involving a considerable amount of manual labor during transport, it requires a storage area to keep the various types of sliver until they are used. Consequently, large areas are dedicated for this "non-productive" purpose which can more productively be used in some other manner.

Accordingly, there is a need for a device and a method for feeding spinning or other textile machines which minimizes the labor necessary for this operation, as well as the storage space needed for the bobbins and reels which are to be fed.

An object of the present invention is to overcome the above-mentioned problems and provide a feeder for textile machines in which the storage function is performed by a structure which, while housing a large number of bobbins of various kinds, occupies a limited space and automatically feeds the textile machines.

A further object of the present invention is to provide a method for feeding textile machines in which the bobbins are stored in a small space and are sent automatically to the textile machines to be fed.

SUMMARY OF THE INVENTION

The present invention discloses a feeder for textile machines having transport means for the continuous transport and supply of a plurality of bobbins; a sliver winder for winding empty ones of the bobbins with a length of sliver; marking means for marking the wound bobbins with a removable code corresponding to predetermined characteristics of the length of sliver; an inlet for transferring the wound bobbins from the sliver winder to the transport means; bobbin handling means for loading, unloading and positioning the plurality of bobbins on the textile machines; a station for inserting the wound bobbins onto the bobbin handling means; reading means at the insertion station for recognizing the code marked on the wound bobbins; a station for removing the empty bobbins from the bobbin handling means; and an outlet for transferring the empty bobbins from the transport means to the sliver winder.

Preferably, the feeder of the present invention further includes means at the removing station for zeroing the code on the empty bobbins, and reading means at the outlet for recognizing the zeroed code on the empty bobbins.

In addition, the present invention discloses a method for automatically feeding a plurality of bobbins to textile machines, in particular, spinning machines, comprising the steps of winding each of the plurality of bobbins with a length of sliver on a sliver winder marking the wound bobbins with a removable code corresponding to predetermined characteristics of the length of sliver; transferring the wound bobbins from the sliver winder to a transport means and transporting them on the transport means; reading the code on the wound bobbins and removing the wound bobbins from the transport means for loading onto a corresponding one of the textile machines according to the code; unwinding the length of sliver from each of the wound bobbins in the textile machines; removing the empty bobbins from the textile machines and zeroing the code thereon; transferring the unwound bobbins onto the transport means; and removing the unwound bobbins from the transport means for insertion into the sliver winder.

BRIEF DESCRIPTION OF THE DRAWINGS

Further features, objects and advantages of the present invention will be more readily understood from the following description when taken with reference to the accompanying drawings in which.

DESCRIPTION OF THE PREFERRED EMBODIMENT

Figure 1:
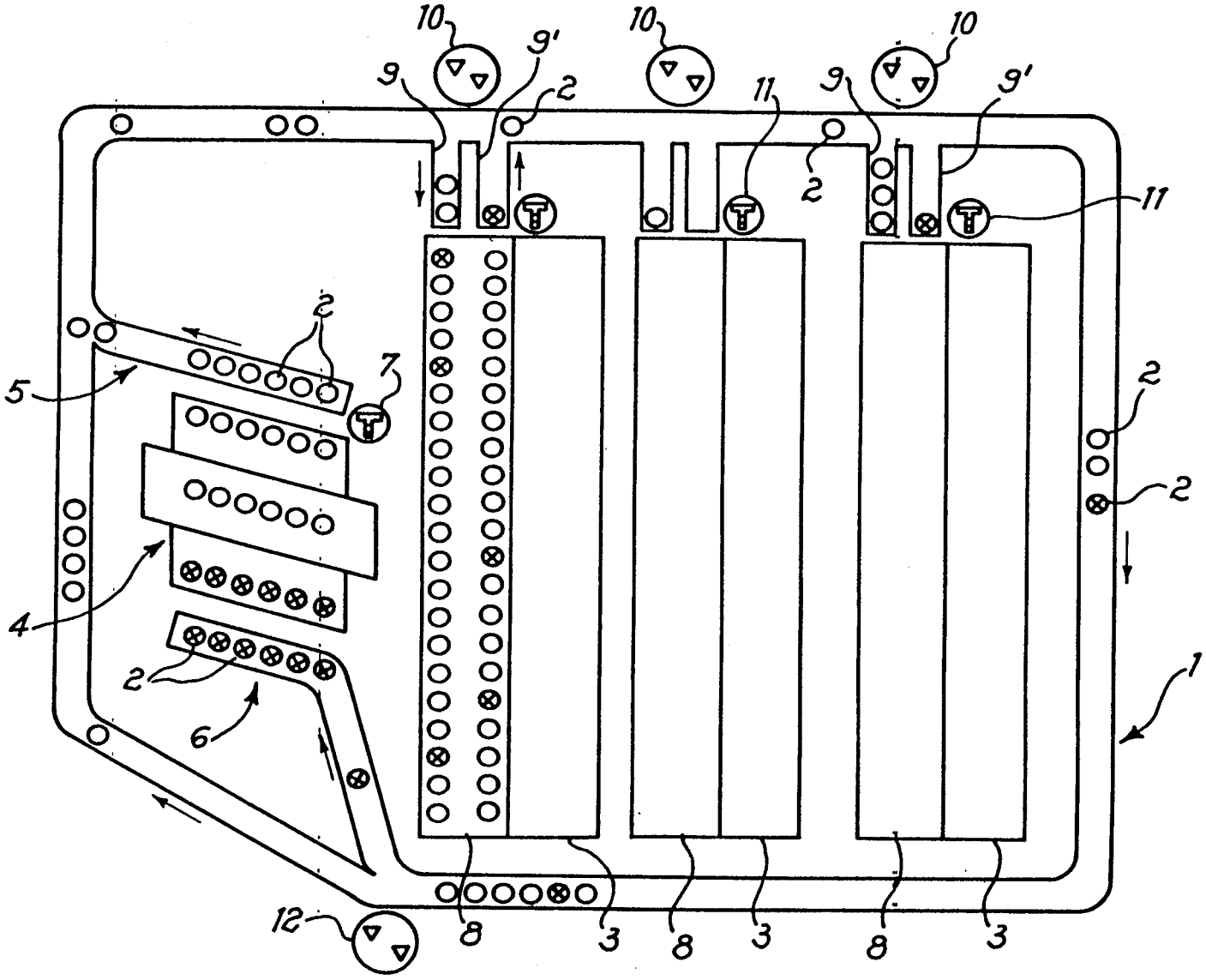
FIG. 1 is a schematic plan view of an automatic feeder according to the present invention being employed with three spinning machines.

FIG. 1 shows a schematic embodiment of a feeder device according to the present invention. The feeder device includes an endless transport structure 1 which continually transports a plurality of bobbins 2 along a track between a winder sliver 4 and a plurality of textile machines; in particular, spinning machines 3.

The bobbins 2 differ in that some are "full", i.e., have sliver wound around them, while others are empty (for convenience, the empty bobbins are marked with an "X" in the drawings although they carry the same reference numeral as the full ones). The full bobbins may have different types and counts of sliver. Although the bobbins may contain yarn or sliver, depending on the type of textile machine being fed, the invention herein will be described with respect to feeding bobbins full of sliver from a sliver winding machine to a spinning machine. However, it will be apparent to those of ordinary skill in the art that when the bobbins contain yarn, the invention herein may be used to feed bobbins full of yarn from, for example, a spinning machine to a different textile machine, such as a loom.

In FIG. 1, the sliver winder 4 has three positions: one for empty bobbins, one for full bobbins, and one for those bobbins on which the winder is winding sliver. Any form of winder that can perform this function can be utilized.

A device 7 is provided downstream of the sliver winder 4 for marking the full bobbins before releasing them onto the endless transporter 1 through an insertion station 5. The marking can be performed in any manner, such as mechanically, electronically, etc. A similar station 6 acts upstream of the sliver winder 4 at the point of arrival of the empty bobbins 2 as they come off the endless transporter 1.

To connect with the spinning machines, the endless transporter 1 has a series of branches each of which extend from the endless transporter 1 to a structure 8 which serves to load, unload and position the bobbins on the spinning machines 3. As can be seen from FIG. 1, each spinning machine has one structure 8 and a pair of sub-branches 9 and 9'.

In each of these pairs, a first sub-branch 9 acts as a buffer and loading station for full bobbins 2 coming into the structure 8, while a second sub-branch 9' acts as an unloading station to unload empty bobbins 2 from structure 8 onto the endless transporter 1.

As previously mentioned, each full bobbin coming off the sliver winder 4 is marked by the device 7 according to the type and count of the sliver it carries. In each of the loading stations there is a reader 10 which reads the markings and is set to load the correct bobbin 2 onto the appropriate structure 8 and spinning machine 3. Thus, the reader 10 selects the appropriate bobbins 2 from those being transported by the endless transporter 1 and sends them to the correct loading station 9.

At the exit from structure 8 there is a zeroing device 11 which, before the empty bobbins 2 are reloaded onto the endless transporter 1, zeros the markings or, more accurately, replaces them with a "zero" marking characteristic of empty bobbins. A reader 12 located on the endless transporter 1 next to exit station 6 is set for the characteristic "zero" marking and, hence, identifies the empty bobbins and sends them to station 6.

For reasons which will be made clear below, it may happen that bobbins which are still partially full may be marked empty. Recognition of these bobbins is entrusted to a sensor (not shown) which removes the empty bobbins and collects them separately.

Figure 2:
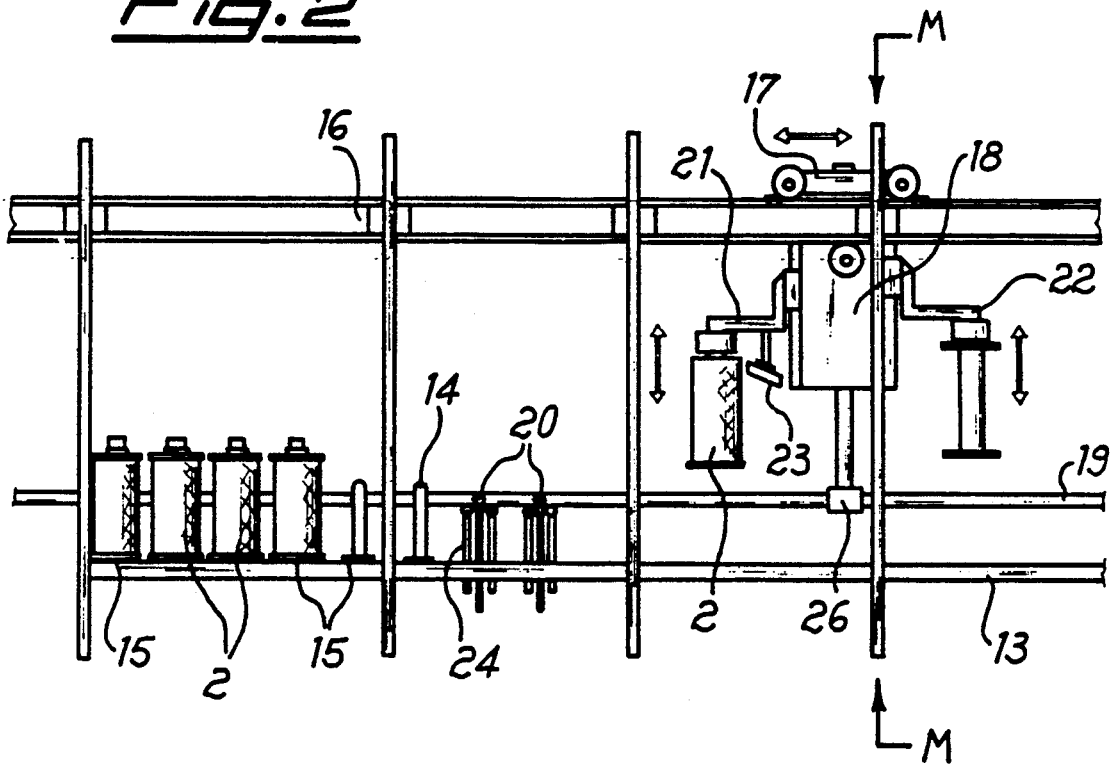
FIG. 2 is a partial side view of a structure according to the present invention for loading and unloading the spinning machines of FIG. 1.
Figure 3:
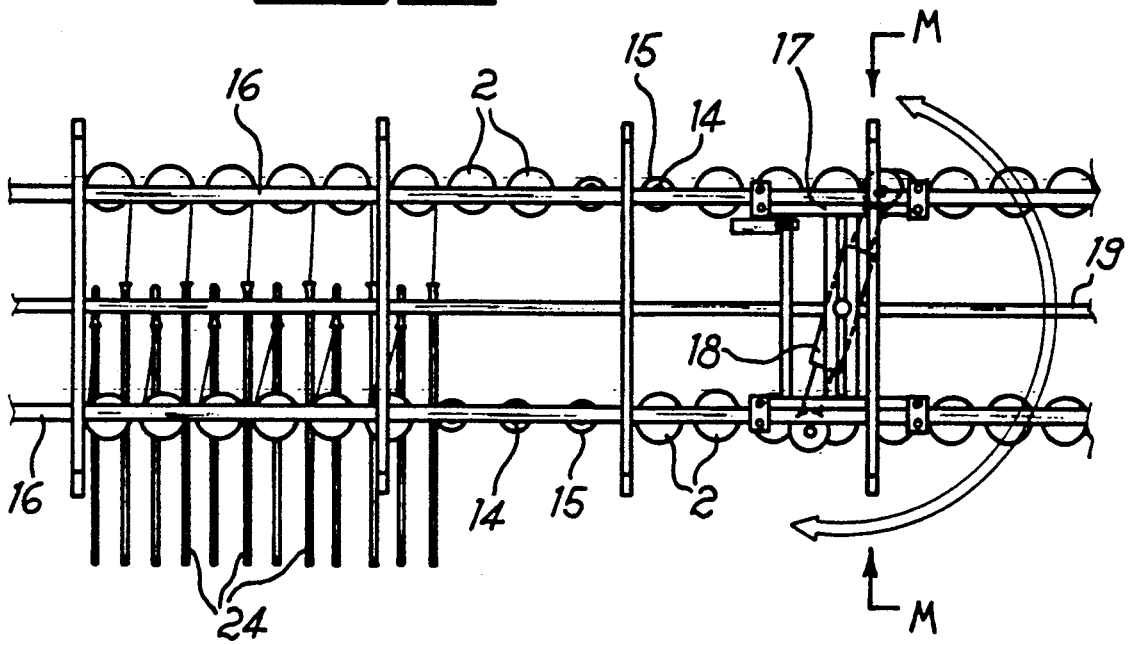
FIG. 3 is a partial plan view of the structure of FIG. 2.

A partial view of structure 8 is shown in FIGS. 2 and 3. It should be noted that structure 8 is symmetrical about the axis M—M and that the part not seen is identical to the part shown. The structure 8 provides an apparatus for positioning the bobbins 2 on a spinning machine 3, the apparatus comprising a double line of spindles 14 freely rotating on their axes and located in fixed positions along two spaced parallel beams 13. Each spindle has an enlarged base 15 to support the base of the bobbin 2 when the bobbin is housed on the spindle 14.

Upstanding stanchions on the beams 13 support rails 16 along which runs a trolley 17. Hanging from the trolley 17 is a device 18 for transporting the bobbins along the positioning apparatus.

A supporting rail 19 positioned between and higher than the beams 13 includes a series of spaced indicators 20 which indicate the condition of the bobbins 2 on the positioning apparatus. A reader 26 of the indicators 20 travels along the rail 19. This reader 26 is integral with the central controlling part of the mobile device 18, stopping the device 18 whenever the indicators 20 signal to do so.

On the sides of the central part of device 18 are two mechanical arms 21 and 22 pointing in opposite directions for lifting, transporting and releasing the full or empty bobbins 2. Both of these arms may move in a vertical direction along the central part of device 18, which in turn can oscillate and rotate along its own vertical axis, as best indicated by the arrow in FIG. 3. Additionally, the arm 21, which is used only for full bobbins, includes a device to rotate the bobbin 2 once the bobbin 2 is positioned on a spindle 14, thereby facilitating the initial spinning of the bobbin 2. Such a device obviously could also be mounted on the second arm 22, thus making either arm capable of moving the full bobbins.

Figure 5:
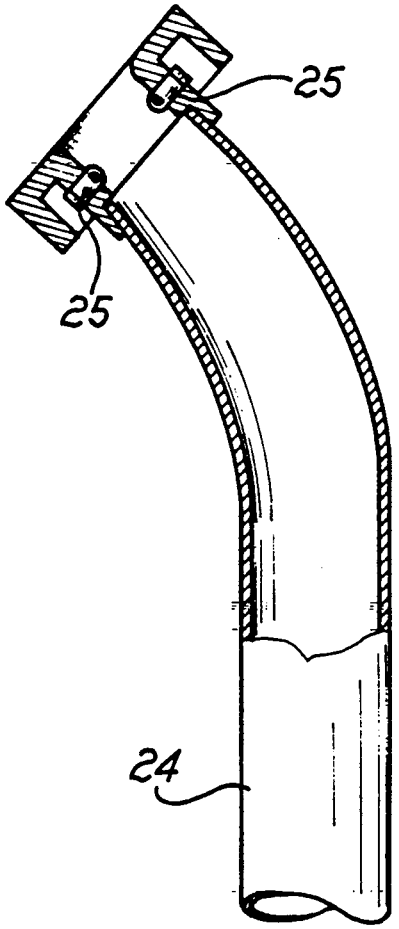
FIG. 5 is a side view of a guide tube broken away in partial cross-section to show the photocell for indicating the presence of sliver in the guide tube.

With the same purpose of facilitating the initial unwinding of the bobbin 2, a preferred embodiment includes an end picker device 23 on the arm 21 and a number of guide tubes 24, one for each bobbin 2, to feed the end of the sliver to the tensioning bar of the corresponding spinning machine 3. At one end of each guide tube 24, preferably at the end nearest the tensioning bar, there is a photocell 25 whose position is shown in greater detail in FIG. 5. As with any typical photocell, one portion of photocell 25 consists of a light source, while the other portion of photocell 25 consists of a receiving cell or photocell detector. The output of photocell 25 is connected to a light source that constitutes the indicator 20 for determining the condition of the bobbins 2. While a bobbin 2 is unwinding and its associated sliver is passing through the guide tube 24 the light source is obstructed and the electric circuit is interrupted. However, when the bobbin is empty and there is no longer any sliver passing through the guide tube 24, the light source impinges upon the photocell detector to complete the circuit and the related indicator 20 is activated.

Figure 4:
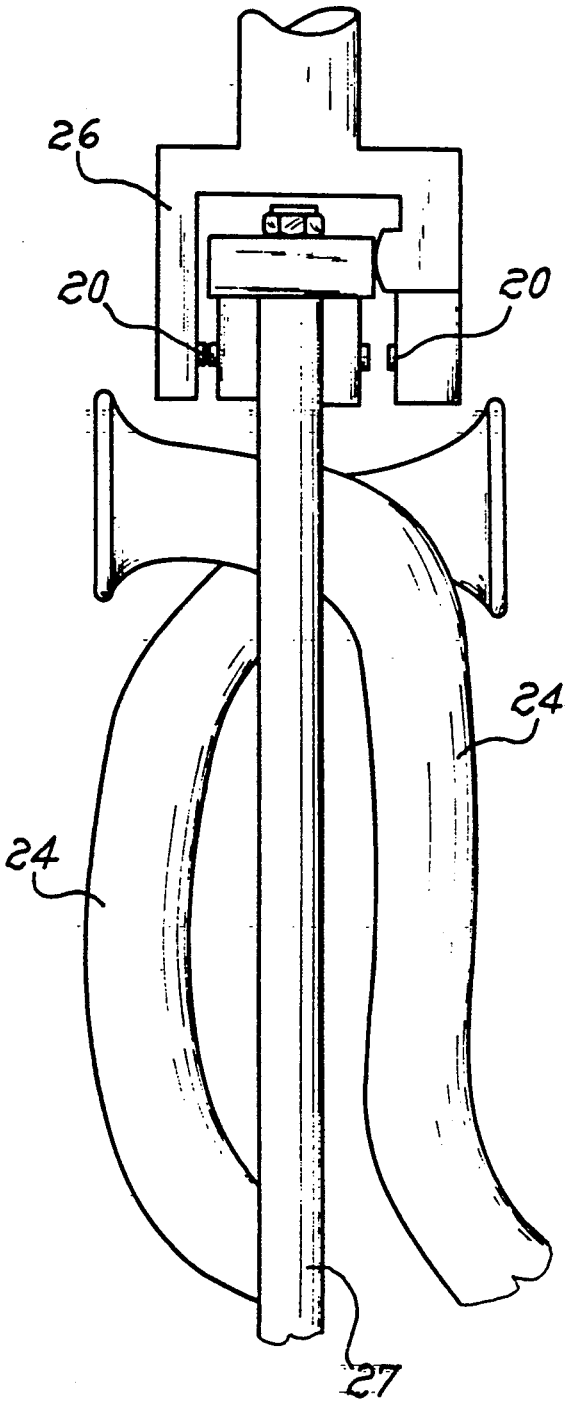
FIG. 4 is a partial side view of a detail of the device of FIGS. 2 and 3 showing the indicator and reader for indicating whether the bobbins are full or empty.

The location of rail 19 and reader 26 in relation to the guide tubes 24 and indicators 20 is shown in greater detail in FIG. 4. As can readily be seen, the rail 19 is supported by the stanchions 27 at a position above but close to the mouths of the guide tubes 24. The indicators 20 are located on both vertical sides of the rail 19, there being a pair indicators 20 for every pair of guide tubes 24. It is worth noting that although the bobbins 2 are located on the two beams 13 disposed on opposite sides of rail 19 to save space, the guide tubes 24 carry the sliver to one spinning machine only.

During the operation of the automatic feeder of the present invention, the bobbins 2 wound by the sliver winder 4 are marked by the marking device 7 according to the count and type of sliver wound upon them. Following winding, the bobbins 2 are admitted onto the endless transporter 1 by the inserting station 5.

Once on the endless transporter 1, the bobbins 2 are circulated with the other bobbins already present, the other bobbins being marked either like or unlike the last inserted bobbins. All of the bobbins 2 are read by the readers 10. Should a spinning machine 3 require more bobbins 2, the respective reader 10 will pass appropriately marked bobbins 2 to the buffer and loading stage 9 of the related structure 8. Should the bobbins 2 not have the correct markings, they will continue on the endless transporter 1 until they meet the appropriate reader 10.

Those bobbins 2 which are fed to the buffer and loading stage 9 will typically encounter other bobbins. After a period of time which can be long or short depending on the number of other bobbins encountered, each bobbin will be lifted by the arm 21 of the mobile device 18 and taken along the positioning apparatus to a spindle 14 where there is an empty bobbin. Those sites at which spindles 14 have empty bobbins are determined by reader 26 as it passes across indicators 20 on rail 19.

Trolley 17 spans the pair of rails 16, carrying the mobile device 18 in a longitudinal direction therealong. In order to provide a more compact apparatus, mobile device 18 is designed to rotate about a central axis so that arms 21 and 22 do not interfere with the bobbins 2 positioned on the beams 13. Thus, as mobile device 18 moves longitudinally along the rails 16, it may be rotated so that arms 21 and 22 are parallel to the direction of travel. As each guide tube 24 runs out of sliver, its respective photocell 25 activates the associated indicator 20. Mobile device 18 stops as it encounters an indicator 20 activated in this manner. It then rotates on its own axis so that arm 22 may remove empty bobbin 2 from spindle 14. Having removed the empty bobbin 2, device 18 then rotates again so that arm 21 may place a full bobbin 2 on the spindle 14 in place of the empty one.

After placing the full bobbin 2 on the spindle 14, the mechanism housed in the arm 21 spins the bobbin 2 in the unwinding direction as device 23 inserts the end of the sliver into the guide tube 24, feeding it along the entire length of the guide tube 24. As the sliver exits the guide tube 24, it interrupts the circuit of photocell 25, thereby deactivating the indicator 20. Conversely, once the bobbin 2 is unwound completely, the sliver does not obstruct the light beam from impinging upon the receiving cell of photocell 25, so that the indicator 20 is activated to signal the presence of an empty bobbin 2.

As the empty bobbin 2 is removed from spindle 14 by the arm 22, it is zeroed by device 11 (which could also be housed in the arm 22) and sent to circulate on the endless transporter 1. Arriving at reader 12, the empty and zeroed bobbin 2 is sent to station 6 where it exits the endless transporter 1. At that point a checking sensor (not shown) determines whether the bobbin 2 is really empty or has been marked so only because the sliver had broken. In those cases where the bobbin 2 is actually empty, the bobbin 2 is directed to the sliver winder 4 to be rewound and sent once again to the endless transporter 1. In those cases where a quantity of the sliver remains on the bobbin 2 due to the breakage of the sliver, the bobbin 2 is segregated from the empty bobbins by the checking sensor and brought to the attention of the machine operator.

I claim:

1. An apparatus for feeding bobbins to textile machines, said device comprising, transport means for the continuous transport and supply of a plurality of bobbins, winding means for winding a length of sliver on empty ones of said plurality of bobbins, marking means for marking said wound bobbins with a removable code corresponding to predetermined characteristics of said length of sliver carried on said wound bobbins, an inlet for transferring said wound bobbins from said winding means to said transport means, bobbin handling means for loading, unloading and positioning said plurality of bobbins on said textile machines, a station for inserting said wound bobbins onto said bobbin handling means, reading means at said inserting station for recognizing said code marked on said wound bobbins.

a station for removing said empty bobbins from said bobbin handling means, and an outlet for transferring said empty bobbins from said transport means to said winding means.

2. An apparatus as claimed in claim 1 further comprising, means at said removing station for zeroing said code on said empty bobbins, and reading means at said outlet for recognizing said zeroed code on said empty bobbins.

3. An apparatus as claimed in claim 1 wherein said transport means further includes a buffer zone between said reading means at said inserting station and said bobbin handling means.

4. An apparatus as claimed in claim 1 wherein said bobbin handling means comprises, a bobbin positioning device for positioning said plurality of bobbins at fixed positions with respect to said textile machines, and carrier means for transporting said plurality of bobbins to said fixed positions.

5. An apparatus as claimed in claim 4 wherein said bobbin positioning device includes, a rotatable spindle at each of said fixed positions, each said spindle acting as a support for one of said plurality of bobbins.

6. An apparatus as claimed in claim 18 further comprising means on said carrier means for rotating said wound bobbins about their vertical axes.

7. An apparatus as claimed in claim 4 wherein said bobbin handling means further comprises, means for guiding said length of sliver through a region between said wound bobbins and said textile machines, and means for sending a signal to indicate the absence of said length of sliver in said region between said wound bobbins and said textile machines.

8. An apparatus as claimed in claim 7 wherein said carrier means includes, at least one mechanical arm for lifting, transporting and releasing said plurality of bobbins, and sensor means for receiving said signal indicating the absence of said length of sliver in said region between said wound bobbins and said textile machines.

9. An apparatus as claimed in claim 8 wherein said carrier means is rotatable about a vertical axis, and said at least one mechanical arm is vertically displaceable.

10. An apparatus as claimed in claim 7 wherein said means for guiding said length of sliver through said region between said wound bobbins and said textile machines comprises guide tube means.

11. An apparatus as claimed in claim 10 wherein said guiding means further comprises, a grasping member for grasping a free end of said length of sliver from said wound bobbin and directing said free end of said length of sliver through an open end of said guide tube means.

12. An apparatus as claimed in claim 10 wherein said means for sending a signal comprises a light source and a photocell detector positioned at said open end of said guide tube means to receive said length of sliver therebetween.

13. An apparatus as claimed in claim 1 wherein said textile machines comprise spinning machines.

14. A method for automatically feeding a plurality of bobbins to textile machines comprising the steps of winding each of said plurality of bobbins with a length of sliver by winding means, marking said wound bobbins with a removable code corresponding to predetermined characteristics of said length of sliver on said wound bobbins, transferring said wound bobbins from said winding means to a transport means and transporting said wound bobbins on said transport means, reading said code on aid wound bobbins and removing said wound bobbins from said transport means for loading onto a corresponding one of said textile machines according to said code, unwinding said length of sliver from each of said wound bobbins in said textile machines, removing said unwound bobbins from said textile machines, zeroing said code on said unwound bobbins, transferring said unwound bobbins to said transport means, and removing said unwound bobbins from said transport means for insertion into said winding means,

15. A method as claimed in claim 14 further comprising the steps of grasping a free end of said length of sliver on each of said wound bobbins and guiding each said length of sliver to said corresponding one of said textile machines prior to unwinding said length of sliver from each of said wound bobbins.

16. A method as claimed in claim 15 further comprising the step of rotating each of said wound bobbins in an unwinding direction during said grasping and guiding steps.

* * * * *

UNITED STATES PATENT AND TRADEMARK OFFICE

CERTIFICATE OF CORRECTION

PATENT NO. : 5,003,762

DATED : April 2,1991

INVENTOR(S) : Enzo Scaglia

It is certified that error appears in the above-identified patent and that said Letters Patent is hereby corrected as shown below:

Column 2, line 42, " winder sliver" should read --sliver winder--.

Column 6, line 18 "18" should read --5--.

Column 6, line 67 "aid" should read --said--.

Column 7, line 12, delete "," insert --.--.

Signed and Sealed this

Twenty-second Day of September, 1992

*Attest:*

DOUGLAS B. COMER

*Attesting Officer*

*Acting Commissioner of Patents and Trademarks*